United States Patent [19]

Lorenz et al.

[11] 4,294,293

[45] Oct. 13, 1981

[54] METHOD OF MIXING COSMETIC MULTI-COMPONENT PREPARATIONS AND SET OF APPARATUS FOR THE PRACTICE OF THE METHOD

[75] Inventors: Heribert Lorenz, Gross-Bieberau; Jürgen Tennigkeit, Seeheim, both of Fed. Rep. of Germany

[73] Assignee: Goldwell GmbH, Darmstadt-Eberstadt, Fed. Rep. of Germany

[21] Appl. No.: 51,035

[22] Filed: Jun. 22, 1979

[30] Foreign Application Priority Data

Jun. 23, 1978 [DE] Fed. Rep. of Germany ..... 2827610

[51] Int. Cl.[3] ..... B01F 15/02; B65B 3/10

[52] U.S. Cl. ..... 141/100; 222/205; 366/267; 141/113

[58] Field of Search ..... 366/142, 262, 267, 150, 366/154, 176, 348, 349; 222/158, 205; 141/100, 113, 9, 102, 104–107

[56] References Cited

U.S. PATENT DOCUMENTS

| | | | |
|---|---|---|---|
| 1,360,761 | 11/1920 | King | 222/158 |
| 1,850,870 | 3/1932 | Featherstone | 222/205 |
| 2,000,493 | 5/1935 | Miller | 222/205 |
| 3,203,454 | 8/1965 | Micallet | 222/205 X |
| 3,773,301 | 11/1973 | Bergeron | 366/348 |
| 4,105,142 | 8/1978 | Morris | 222/158 |

*Primary Examiner*—Edward J. McCarthy

[57] ABSTRACT

A set of apparatus for preparing cosmetic multi-component preparations from at least two preparation components of which at least one is liquid and the other in paste or liquid form, having a pump which can be inserted into the dispensing orifice of a first supply container containing the liquid first preparation component, the suction connection thereof being immersed in the preparation component contained in the supply container and its discharge connection being so formed that it can be sealingly connected to a self-closing bottom valve of a mixing container serving for receiving and mixing of the multi-component preparation. A pressure container is provided, in which a second supply container is disposed which is volume-variable, is filled with the additional paste or liquid preparation component and is connected to an external dispensing valve. The space remaining between the second supply container and the inside walls of the pressure container is filled with a propellant under pressure. The dispensing valve can be sealingly connected to the bottom valve of the mixing container.

21 Claims, 3 Drawing Figures

METHOD OF MIXING COSMETIC MULTI-COMPONENT PREPARATIONS AND SET OF APPARATUS FOR THE PRACTICE OF THE METHOD

BACKGROUND

The invention relates to a method of mixing cosmetic preparations composed of at least two components, which can be in liquid or paste form, and which have to be mixed together immediately prior to use, especially for mixing a ready-to-use hair dye preparation immediately before use, and it relates to a set of apparatus for the practice of the method.

Certain cosmetic preparations have to be mixed immediately prior to use because they are composed of two or more substances which react with one another chemically after being mixed, and which no longer produces the desired effect after this reaction has ended. This is the case, for example, with hair dye preparations which are made from the actual dye in liquid or paste form and a liquid oxidant just prior to application to the hair, and then have to be used immediately, i.e., applied to the hair. In the use of these hair dyes the procedure has hitherto been for the user, i.e, the hairdresser as a rule, to place the required amount of the components into a dyeing dish, mix them together, and then apply the mixture immediately to the customer's hair. In this procedure, the hairdresser must first measure the components relatively precisely, because if they are not in correct proportion the desired tint will not be achieved. The dye component in paste form has formerly been measured out either by forcing a strand of it from the tube containing it, to a length selected as the measure of the quantity, or the dye has been forced from a tube calibrated by uniform marking, until the desired mark is reached. It can readily be understood that the determination of quantity by measuring the length of the strand from the tube or by forcing out the contents of the tube until a certain mark is reached is imprecise, because in the one case the strand from the tube will have a greater or lesser diameter according to whether it has been stretched or compressed, so that such strands of equal length can contain different amounts of the components, while in the other case the imprecision is to be attributed to the fact that when the tube is squeezed out to a certain mark, the tube containing the rest of the contents may also have been narrowed down to a greater or lesser extent so that differences can be produced. The liquid component can be measured more precisely by using a graduate, but this is of no benefit if the paste dye component is not correctly measured. Measuring the liquid component with a graduate is furthermore a nuisance, and it is not impossible that the precisely measured amount of liquid might not all be poured out into the mixing dish.

THE INVENTION

The object of the invention therefore is to simplify the method hitherto used in mixing the components of the preparation, to make it quicker, and especially to assure a more precise maintenance of the proportions of the components in the ready-to-use mixture.

For the solution of this problem, the procedure of the invention consists in delivering, from a source of supply of the first component, a given amount of this component up through a self-closing bottom orifice into a mixing vessel, then driving a given amount of the second component from a source of supply thereof up through the same bottom orifice into the dish, and lastly mixing the two components intimately together in the dish. The delivery of the components into the mixing dish is therefore accomplished without complex manipulation by pumping them up through the bottom thereof, so that the rise of the amount of the component in the dish is observable and its quantity can also be precisely controlled, for example by means of calibration marks on the dish, so that, when the correct amount has been reached, the feed of the material can be immediately stopped. Preferably, the liquid component of the preparation is pumped up through the bottom opening of the mixing dish, and then the paste component, initially stored in a chamber of variable volume, is squeezed up through the bottom orifice into the mixing dish by reducing the volume of the variable-volume chamber.

In the preparation of a hair dye in accordance with the invention, then, the first component of the preparation is a liquid oxidant, preferably hydrogen peroxide, and the second component is a hair dye paste.

For the practice of the method of the invention, a set of apparatus is used, which is composed of a mixing vessel, such as a dye dish or an applicator container or bottle, which is provided with a self-closing bottom valve, of a pump which can be inserted into the dispensing orifice of a supply vessel containing one of the components, the suction connection of which is immersed in the component contained in the supply vessel and the discharge nozzle of which is made such that it can be sealingly connected to the bottom valve of the mixing vessel, and lastly of a pressure vessel in which there is disposed a supply vessel filled with another component of the preparation, whose volume is variable and which is connected to an external dispensing valve, the volume of the latter supply vessel being smaller than that of the pressure container, and the free space remaining between the supply vessel and the inner walls of the pressure vessel being filled with a propellant that is under pressure. The set of apparatus therefore comprises three individual apparatus, which are adapted to one another such that either the pump or the pressure container can be selectively connected sealingly to the bottom valve of the mixing vessel.

The precise measurement of the amount of the components to be mixed can be assured quite simply by providing the mixing vessel with a measuring scale, calibrated in milliliters for example, for determining the amount of the components that is pumped into it. Alternatively, the mixing vessel can also be provided with marks indicating the prescribed amounts of the components to be pumped into it.

The bottom valve is preferably disposed removably in an opening in the bottom of the mixing vessel, so as to make it easy to remove for cleaning. Preferably, the bottom valve is held in the opening in the bottom of the mixing vessel by a bayonet-type lock.

The mixing vessel, in a preferred further development of the invention, is provided with a hollow pedestal which is open at the bottom and whose inside diameter is such that either the upper part of the pressure vessel equipped with the dispensing valve or the discharge nozzle of the pump can be fitted into it. The pump provided for the injection of the liquid component of the preparation into the mixing vessel is preferably a piston pump which can be inserted into the mouth of the supply vessel, and whose piston is biased by a spring to an outermost position of maximum intake volume in which a plunger joined to the piston protrudes from the supply vessel by the length of the piston stroke, and can be moved towards the interior of the vessel by the length of the piston stroke, against the action of the spring. To deliver the component of the preparation into the mixing vessel, the latter is placed over the plunger and the discharge nozzle is attached to the bottom valve. Then the mixing vessel is pushed downwardly, causing the plunger to push down the piston which thus performs a working stroke, i.e., the liquid component previously aspirated into the pump cylinder is displaced through the plunger and the bottom valve into the mixing dish. The spring which is thus compressed then returns the piston and with it the plunger to the starting position, thereby aspirating more liquid into the pump cylinder from the supply vessel. The displacement of the piston pump is best made such that one or more full piston strokes will transfer precisely the amount of material required into the mixing vessel. It is then unnecessary to observe the amount of the liquid component with the aid of a measuring scale.

Since the operation of the pump in the manner described above is performed by means of a mixing vessel placed on the plunger, it is desirable to provide the discharge nozzle of the pump at the end of the plunger, the plunger being then made hollow and bearing the discharge nozzle on its outer, free end, the piston then being provided with an orifice leading to the interior of the hollow plunger, which can be stopped by a ball check valve.

To assure that the mixing vessel will not slip off from the plunger and discharge nozzle, and that it will not be out of alignment therewith, a further advantageous development of the invention provides for a guiding collar open at the top and annularly surrounding the plunger to be disposed on the supply vessel of the second component of the preparation, the inside diameter being selected to correspond approximately to the maximum outside cross sectional dimensions of the pedestal, and guiding the pedestal as the plunger is depressed such that the discharge nozzle of the pump will be aligned with the bottom valve of the mixing dish. The guiding collar is preferably combined with the pump so as to form a unit.

To assure that the mixing vessel placed on the plunger will be kept precisely horizontal when the pump is operated, so as to avoid any falsification of the reading on the scale of the amounts of fluid transferred to the mixing vessel, a pressure plate guided within the guiding collar and made of a size corresponding to the inside diameter of the collar can be fastened on the outer end of the plunger, and on it the pedestal of the mixing vessel can be supported horizontally when the discharge connection of the pump is connected to the bottom valve of the mixing vessel. Any tipping of the mixing vessel from the horizontal is then no longer possible.

The variable-volume supply vessel disposed in the pressure vessel and containing the first component of the preparation separate from the propellant can be manufactured from a deformable, thin aluminum material, coated on the inside, if necessary, with a varnish-like protective coating. Alternatively, the supply vessel can be made of a plastic film bonded with a metal foil. All that must be assured is that the supply vessel under gas pressure will be easily compressible, so that the component which it contains will be driven out of the pressure vessel when its dispensing valve is opened.

Particularly when the supply vessel has an approximately cylindrical shape with a closed bottom, and is fastened at its upper margin to the case of the pressure vessel, there is a tendency for the supply vessel to begin to deform inwardly from approximately the middle of its cylindrical circumference as it becomes increasingly empty, while the stiffer bottom area yields less easily to the deformation. At the same time it can happen that the supply vessel will be compressed in the middle until the originally cylindrical walls meet, so that then in the bottom area a closed-off, sack-like portion still filled with the component will be formed, from which the component can no longer be expelled. To prevent this, the dispensing valve of the pressure vessel, in further development of the invention, is connected to a riser tube extending into the supply vessel and having a wall thickness such that its cross section cannot be deformed by the pressure prevailing in the pressure vessel. This will assure that a component of the preparation that might be trapped in the bottom area as described can be expelled through the riser and the supply vessel can thus be completely emptied.

Furthermore, it is recommendable that, in addition to the aperture at the bottom end for the admission of the first component of the preparation, the riser tube also be provided with at least one additional admission aperture in the vicinity of its connection to the dispensing valve, so that any material that might be trapped above the constricted portion of the vessel can be completely removed.

Since the bottom of the supply vessel might rise slightly as its volume is reduced by the gas pressure, the riser tube is preferably given a length amounting to approximately two-thirds of the height of the supply vessel. This will prevent the bottom from coming against the lower orifice of the riser tube and closing it.

The upper part of the pressure vessel is preferably provided with a cap having guiding means which come into engagement with complementary guiding means provided inside of the pedestal of the mixing vessel when the mixing vessel is placed on the pressure vessel, such that the dispensing valve of the pressure vessel will be positively aligned with the bottom valve of the mixing vessel.

The cap has preferably the shape of a truncated cone entering partially into the hollow interior of the pedestal of a mixing vessel superimposed on the pressure vessel, the mixing vessel edge defining the hollow interior of the pedestal resting on the peripheral surface of the cap when the guiding means are engaged and the dispensing valve has been connected to the bottom valve. In this manner the horizontal alignment of the mixing vessel is assured during the filling action at the pressure vessel.

The invention will be further explained in the following description given in conjunction with the drawings, wherein.

Figure 1:
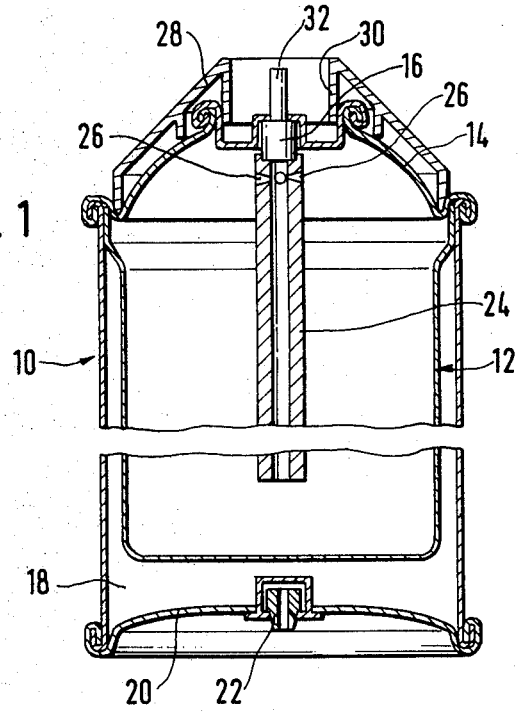
FIG. 1 is a vertical cross-sectional view taken through a pressure vessel of the set of apparatus in accordance with the invention, which contains one of the components of the preparation.
Figure 2:
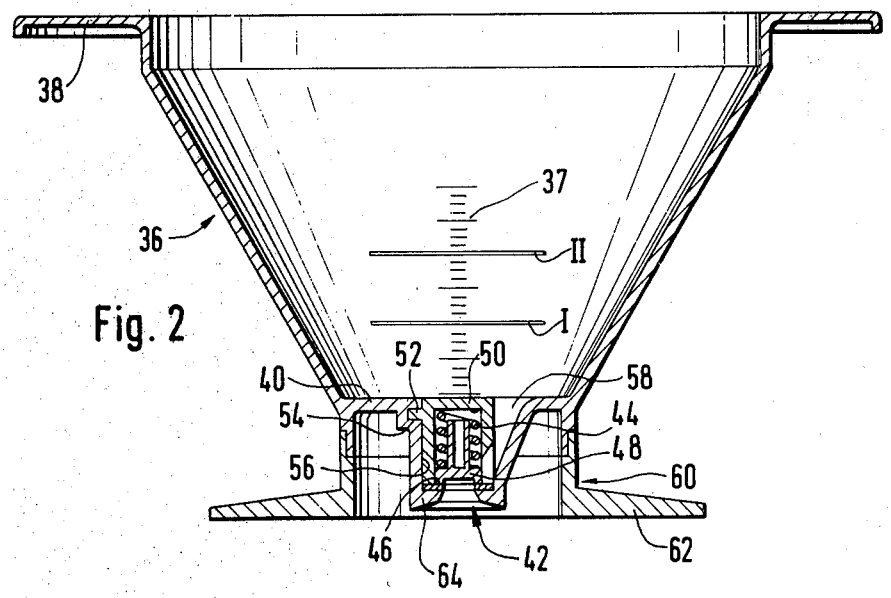
FIG. 2 is a vertical cross-sectional view taken through the corresponding mixing vessel in which the multi-component preparation is prepared by mixing together the individual components.
Figure 3:
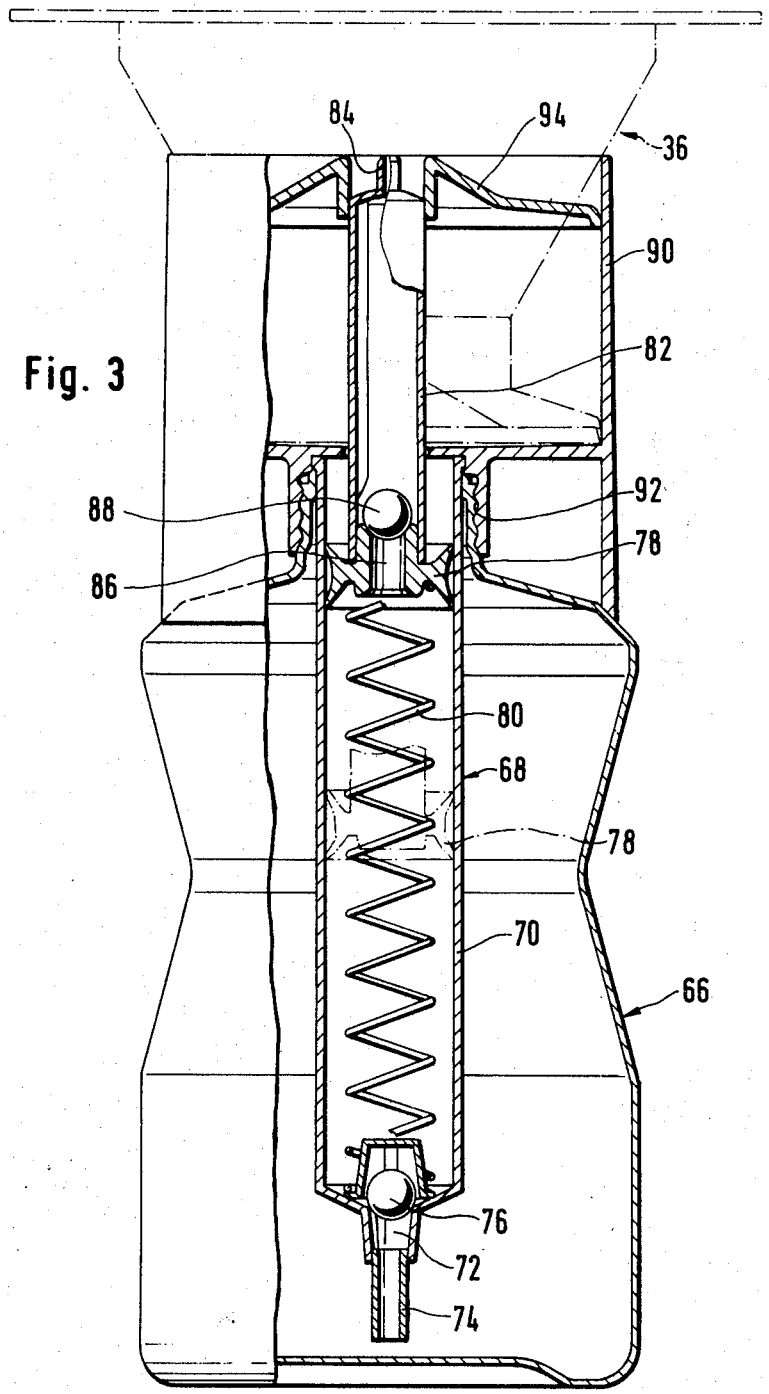
FIG. 3 is a vertical, partially cut-away view of the pump of the set of apparatus in accordance with the invention, which is superimposed on a supply vessel for an additional component of a preparation.

In each of the FIGS. 1 to 3 there is shown one of the three individual apparatus pertaining to the set in accordance with the invention, the set serving in the illustrated case for the mixing of a hair dyeing preparation to make it ready for use, the preparation being composed of a dye component in paste form and a liquid oxidant (e.g., hydrogen peroxide).

The dye component in paste form is stored in the pressure container 10, whose external appearance is similar to that of a common aerosol spray can. In contrast to such aerosol spray cans, the dye component and the propellant are separate from one another in the pressure container 10 so as to reliably prevent undesired chemical reactions. This separation is accomplished (in a known manner, e.g., German Auslegeschrift No. 2,103,447) by inserting into the external pressure container a reservoir (12) receiving the paste dye component, which communicates with the dispensing valve 16 of conventional construction inserted in the upper dome 14 of the pressure container. By the compression of the reservoir 12, which is made, for example, of a thin, pliable aluminum material, the dye component can emerge when the valve 16 is open. This compression is brought about by a propellant contained under pressure in the space 18 between the reservoir 12 and the pressure container 10, this propellant being introduced into the pressure container through a valve provided in the bottom 20 of the pressure container 12. The propellant can be either inert gases, such as $CO_2$ or nitrogen, or also the fluorinated hydrocarbons used as propellants in aerosol cans.

A relatively thick-walled riser tube 24 connected to the dispensing valve 16 extends over about two-thirds of the length of the reservoir 12 to a short distance above its bottom and assures that the dye component will be completely discharged even if the walls of the reservoir have been forced in against the riser tube, trapping a residue of the dye component in a sack-like pocket below it. The cross bores 26 at the upper end of the riser tube 24 also permit entry of the dye component directly adjacent the dispensing valve 16, thereby assuring that all of the dye component stored in the reservoir can be completely dispensed.

A truncoconical cap 28 snapped onto the dome 14 serves for the adaptation and alignment of the pressure container 10 to the dish-like mixing vessel yet to be described below in conjunction with FIG. 2. The upper, circularly defined truncoconical surface of the cap 28 is open and, centrally within the space defined by a cylindrical wall 30, and accessible through this opening, is the dispensing tube 32 of the dispensing valve 16, which opens upon the depression of the dispensing tube.

FIG. 2 shows the above-mentioned, dish-like mixing container 36, which in the illustrated case is in the form of an inverted truncated cone. A flange-like finger-grip 38 projecting radially all around facilitates the handling of the container. In the bottom 40 of the mixing container 36 there is removably inserted a bottom valve 42, and in particular the valve body 48, urged by a spring 44 against a seal on the annular seat 46 in the mixing container 36 is inserted in a cylindrical valve cup 50, which is held in the wall of a cylindrical recess 56 in the bottom 40 of the mixing container 36 in a bayonet-like manner by projections 52 engaging grooves 54 in the wall. Passages 58 flaring upwardly from the annular seat 46 permit the unhampered access of the preparation components to be injected through the bottom valve 42 into the mixing container. They also facilitate the complete cleaning of residues from the mixing container after use.

Inside of the mixing container 36 there is provided a measuring scale 37 calibrated, for example, in milliliters, for determining the quantity of the components injected. Alternatively or additionally, two marks I and II can be provided, which indicate the level to which the dish must be filled with each of the components of the preparation in order to achieve a precise proportioning of a special two-component preparation. The mixing container stands on a cylindrical, hollow pedestal 60 which is open at the bottom, from which there extends radially a flat-bottomed flange 62 to improve stability. Within the pedestal 60 is situated the cylindrical portion 64 of the bottom 40 of the mixing container 36, which contains the bottom valve 42. This cylindrical portion 64 has such a diameter that it just fits into the chamber defined by the cylindrical wall 30 in the cap 28 of the pressure container 10. The cylindrical portion 64 and the above-mentioned chamber in the cap 28 thus constitute mating guiding means which engage one another when the mixing container 36 is superimposed on the pressure container 10, and align the dispensing tube 32 precisely with the orifice of the bottom valve 42. By depressing the mixing container 36 placed on the pressure container 10, the dispensing valve 16 of the pressure container is opened and the dye component contained in the reservoir 12 is transferred through the bottom valve 42 into the mixing container.

The leveling of the mixing container 36, which is necessary for the correct reading of the quantity of the component delivered into the mixing container on the scale 37 or the measuring marks I or II is assured by the fact that when it is placed on the pressure container 10, the edge of the hollow pedestal 60 comes to rest on the conical surface of the cap 28 and thus, if the pressure container is standing on a horizontal surface, a leveling of the mixing container 36 superimposed on the pressure container 10 is achieved.

The pump 68 serving for the delivery of the liquid oxidant contained in a bottle 66 to the mixing container 36 is illustrated in FIG. 3. The pump 68 is a piston pump whose cylinder 70 is of such a diameter that it can be introduced into the bottle 66 through the neck thereof. The suction connection 72 of the pump is provided at the bottom end of the cylinder 70. In the case of taller reservoirs in which the suction connection is at a distance above the container bottom, a suction tube 74 extending from the suction connection to a point close to the bottom is provided. In the suction connection 72 there is inserted a ball check valve 76 which prevents any return of liquid aspirated into the cylinder 70. The piston 78 is biased towards its uppermost position by a coil spring 80 disposed in the cylinder. Also, a hollow plunger 82 attached to the piston 78 on the side opposite the spring protrudes from the cylinder. The end of the plunger 82, like the dispensing tube 32 of the pressure container, is in the form of a discharge nozzle 84 which can be sealingly attached to the bottom valve 42 of the mixing container.

A passage orifice 86 in the piston 78 permits liquid aspirated into the cylinder 70 to flow into the hollow interior of the plunger 82 and to the discharge nozzle 84. A check valve 88 in the form of a ball opposite the passage orifice on the plunger side prevents the liquid that has flowed into the plunger from returning to the cylinder 70 during the working stroke of the piston 78. The injection of the liquid oxidant into the mixing container, therefore, is performed by placing the bottom valve 42 of the mixing container over the discharge nozzle 84 of the pump 68 and then pressing the container downwardly. The plunger then forces the piston 78 downwardly against the action of the coil spring 80, liquid oxidant contained in cylinder 70 passing through the passage orifice 86 into the plunger and from there through the discharge nozzle 84 into the mixing container. When the container is then lifted upwardly again, the spring 80 also forces the piston and with it the plunger upwardly, thereby aspirating more liquid oxidant from the supply bottle 66 into cylinder 70 through the suction orifice 72. The diameter of the piston and its stroke are best interrelated such that the precise amount of liquid required for the production of a ready-for-use mixture will be delivered by one (or more) full strokes of the piston, since this will additionally facilitate the proportioning. On the other hand, the proportioning of the liquid component of the preparation can of course by accomplished also by observing the rise of the level of the oxidant in the container to a specified level that can be read on the milliliter scale 37 or at one of the measurement marks I or II.

To assure that the bottom valve 42 of the mixing container 36 will be correctly aligned with the discharge nozzle 84 of the pump and that the mixing container will be guided in correct alignment with the discharge connection during the pump stroke, a guiding collar 90 annularly surrounding the plunger and open at the top is placed on the outer end of the cylinder 70 and can be screwed by means of a screw thread onto the neck of the supply bottle 66. The guiding collar 90 has an inside diameter corresponding to the cross-sectional dimensions of the annular flange 62 of the pedestal 60, and is of such a height that the annular flange 62 will be guided within the guiding collar during the full length of the pump stroke. The guiding collar is best joined to the pump so as to form a single unit therewith.

The precise leveling of the mixing container 36 with respect to the pump 68, which is necessary for the precise determination of the amount of oxidant injected into the mixing container with the aid of the scale 37 or the measuring marks I and II, is assured by a pressure plate 94 fastened to the outer end of the plunger 82, which is guided on the inside surface of the guiding collar 90 and is displaceable together with the plunger. The pedestal 60 of the mixing container 36 is supported in the necessary horizontal position by the pressure plate 94 also during the pump stroke.

For the case that is being here considered, namely that a ready-to-use hair dye preparation is to be mixed from a dye component in paste form and a liquid hydrogen peroxide, it is desirable first to pump the necessary amount of hydrogen peroxide from the supply bottle 66 into the mixing container 36, and then to inject the dye component into the mixing container from the pressure container 10. This method of procedure has the advantage that the level of the first liquid injected can serve as an indicator during the subsequent injection of the paste component. In this manner, inaccuracies in the proportioning of a very viscous component of the preparation, which upon flowing into the mixing container would not have the planar surface comparable to the surface of a liquid, can be prevented.

It is apparent that modifications and improvements are possible within the scope of the invention. If, for example, both of the components to be mixed in the mixing container are liquid, the pressure container 10 is replaced by another pump similar to pump 68, suitable for the delivery of liquid preparations. If, on the other hand, both components of the preparation are of a paste-like consistency, the mixing container is used in conjunction with two pressure containers each containing one of the preparation components. It is essential in any case that the components of the preparation, which are to be combined in the mixing container by intimate mixing and are then to be used, are delivered from containers whose dispensing connections are adapted to the bottom valve of the mixing container.

It is possible to expand the system such that more than just two components of a preparation are injected into the mixing container through the bottom valve—for example in the case of mixing formulas for the achievement of intermediate tints—without making any basic change in the function of the mixing container or of the component containers that can be connected thereto.

We claim:

1. A set of apparatus comprising:

a first supply container for a liquid first preparation component and having a dispensing orifice, a piston pump adapted to be inserted into said dispensing orifice and having a piston, and a plunger connected to said piston, a spring biasing said piston to an outer position of maximum stroke volume in which said plunger protrudes from said first supply container by the length of the piston stroke and adapted to be displaced by pressure on said plunger against the action of said spring towards the interior of said first container by the length of the piston stroke, said piston pump also having a suction connection adapted to be immersed in the preparation component when contained in the supply container and also having a discharge connection, a mixing container for receiving and mixing of a multi-component preparation and having a self-closing bottom valve and a pedestal, said discharge connection adapted to be sealingly connected to said self-closing bottom valve, a guiding housing open at the top, annularly surrounding the plunger and adapted to be disposed on said first supply container, the free cross-section of said guide housing conforming to the outer cross-sectional dimensions of said pedestal and guiding the pedestal upon the depression of the plunger, such that the discharge connection of the pump is adapted to be aligned with the bottom valve of the mixing container, a pressure container, a second supply container being disposed in said pressure container and being volume-variable and adapted to be filled with an additional paste or liquid preparation component, an external dispensing valve in communication with said second supply container, the capacity of said second supply container being smaller than the capacity of the pressure container, the space remaining between the second supply container and the inside walls of the pressure container being filled with a propellant under pressure, said dispensing valve being adapted to be sealingly connected to the bottom valve of said mixing container.

2. The set of apparatus according to claim 1, wherein said mixing container is provided with a measuring scale for the determination of the amounts of the preparation components which are placed in it.

3. The set of apparatus according to claim 2, wherein the mixing container is provided with markings for the determination of given amounts of the preparation components to be placed in it.

4. The set of apparatus according to claim 1, wherein said bottom valve is removably disposed in an opening in the floor of the mixing container.

5. The set of apparatus according to claim 4, comprising bayonet-like locking means for holding said bottom valve in the opening in the bottom of the mixing container.

6. The set of apparatus according to any one of claims 1 to 5, wherein said pedestal is open at the bottom with an inside diameter such that the pedestal is adapted to receive the upper part of the pressure container provided with the dispensing valve, and the discharge connection of the pump.

7. The set of apparatus according to claim 1, wherein said pump has a cylinder and said plunger is hollow and has an outer, free end bearing said discharge connection of said pump, said piston having a passage opening from the pump cylinder to the interior of the hollow plunger.

8. The set of apparatus according to claim 7, comprising a check valve closing said passage.

9. The set of apparatus according to claim 1, wherein said guiding housing is joined to the pump to form a pump unit which can be handled as a unit.

10. The set of apparatus according to claim 1, wherein a pressure plate is fastened on said outer, free end of the plunger, said pressure plate being dimensioned in accordance with the clear cross-section of said guiding housing and guided in said guiding housing, said pedestal of said mixing container resting in horizontal orientation on said plate when the discharge connection of the pump is connected with the bottom valve of the mixing container.

11. The set of apparatus according to claim 1, wherein said second supply container disposed in said pressure container is manufactured of pliable thin aluminum material.

12. The set of apparatus according to claim 11, wherein the inside of said second supply container is coated with a protective coating.

13. The set of apparatus according to claim 1, wherein said second supply container disposed in the pressure container is manufactured of a plastic film laminated to a metal foil.

14. The set of apparatus according to claim 1, comprising a riser tube leading into said second supply container, said dispensing valve of said pressure container being connected to said riser tube, the wall thickness of said riser tube being such that its cross-section is not deformable under the action of the pressure prevailing in the pressure container.

15. The set of apparatus according to claim 14, wherein said riser tube has an aperture for the entrance of the first preparation component at the bottom end, and at least a second aperture in the vicinity of its connection to said dispensing valve.

16. The set of apparatus according to claim 15, wherein said second aperture is a transverse bore.

17. The set of apparatus according to claim 14, 15 or 16, wherein said riser tube has a length of about $\frac{2}{3}$ of the height of the second supply container.

18. The set of apparatus according to claim 6, wherein the upper part of the pressure container is provided with a cap with first guiding means, second guiding means complementary to said first guiding means within said pedestal, said first guiding means when the mixing container is placed on the pressure container, coming into engagement with said second guiding means, such that the dispensing valve of the pressure container is possibly aligned with the bottom valve of the mixing container.

19. The set of apparatus according to claim 18, wherein said first guiding means is a cylindrical wall at said cap and said second guiding means is a cylindrical wall portion of said pedestal.

20. The set of apparatus according to claim 18, wherein said cap has the form of a truncated cone entering partially into the hollow interior of the pedestal of said mixing container superimposed on the pressure container, the edge of the mixing container bounding the hollow interior of the pedestal resting on the peripheral surface of the cap after said first and second guiding means have come into engagement with each other and the dispensing valve has been connected to the bottom valve.

21. A set of apparatus comprising: a first supply container for a liquid first preparation component and having a dispensing orifice, a piston pump adapted to be inserted into said dispensing orifice and having a suction connection adapted to be immersed in the preparation component when contained in the supply container and also having a discharge connection, a mixing container for receiving and mixing of a multi-component preparation and having a self-closing bottom valve removably disposed in an opening in the bottom of the mixing container, and bayonet-like locking means for holding said bottom valve in the opening in the bottom of the mixing container, said discharge connection adapted to be sealingly connected to said self-closing bottom valve, a pressure container, a second supply container being disposed in said pressure container and being volume-variable and adapted to be filled with an additional paste or liquid preparation component, an external dispensing valve in communication with said second supply container, the capacity of said second supply container being smaller than the capacity of the pressure container, the space remaining between the second supply container and the inside walls of the pressure container being filled with a propellant under pressure, said dispensing valve being adapted to be sealingly connected to the bottom valve of said mixing container.

* * * * *